United States Patent [19]

Najjar et al.

[11] Patent Number: 4,904,277

[45] Date of Patent: Feb. 27, 1990

[54] REHYDRATING INHIBITORS FOR PREPARATION OF HIGH-SOLIDS CONCENTRATION LOW RANK COAL SLURRIES

[75] Inventors: Mitri S. Najjar, Hopewell Junction; James R. Pascoe, Wappingers Falls, both of N.Y.; Ralph Garcia, Gulf Port, Fla.

[73] Assignee: Texaco Inc., White Plains, N.Y.

[21] Appl. No.: 840,233

[22] Filed: Mar. 17, 1986

[51] Int. Cl.[4] ..... C10L 1/32

[52] U.S. Cl. ..... 44/51; 44/53; 44/62; 44/77; 34/9; 34/12; 34/22

[58] Field of Search ..... 44/51, 1 R, 53, 62, 44/77; 34/9, 12, 22

[56] References Cited

U.S. PATENT DOCUMENTS

| | | | |
|---|---|---|---|
| 2,610,115 | 9/1952 | Lykken | 34/9 |
| 3,953,927 | 5/1976 | Hoffert | 34/9 |
| 3,996,026 | 12/1976 | Cole | 44/51 |
| 4,057,399 | 11/1977 | Cole et al. | 44/6 |
| 4,212,127 | 7/1980 | LaDelfa et al. | 34/9 |
| 4,223,449 | 9/1980 | Bodle et al. | 34/9 |
| 4,304,572 | 12/1981 | Wiese et al. | 44/51 |
| 4,309,191 | 1/1982 | Hiroyuki et al. | 44/51 |
| 4,309,192 | 1/1982 | Kubo et al. | 44/51 |
| 4,486,959 | 12/1984 | Chang | 34/9 |

*Primary Examiner*—Jacqueline V. Howard
*Assistant Examiner*—Margaret B. Medley
*Attorney, Agent, or Firm*—Robert A. Kulason; James J. O'Loughlin; Vincent A. Mallare

[57] ABSTRACT

A method for preparing a high-solids concentration low rank coal slurry by dehydrating the coal, treating the dehydrated coal with a rehydrating inhibitor such as a ($C_3$–$C_{12}$) alcohol and adding a surfactant to the treated coal, whereby the concentration of the solids is increased from about 5 to about 20 wt. %.

3 Claims, No Drawings

REHYDRATING INHIBITORS FOR PREPARATION OF HIGH-SOLIDS CONCENTRATION LOW RANK COAL SLURRIES

BACKGROUND OF THE INVENTION

1. Field of the Invention

This invention relates to the gasification of coal, and more particularly it relates to the preparation of a high-solids concentrated low rank cool slurry for a coal gasification process.

The gasification of solid fuels, such as low rank fuels, e.g., coal, is well known. Several methods have been proposed for such a procedure. In one method the solid fuel is ground to a fine powder and fed to the gas generator as a suspension in a vaporous medium, e.g., steam or in a gaseous medium such as a free oxygen-containing gas. However, this method is unsatisfactory as it is difficult to control the amount and rate of solid fuel fed to the gas generator. In addition, if the solid fuel is suspended in a free oxygen-containing gas, care must be taken to maintain the velocity of the suspension above the rate of flame propagation to avoid a backflash which to say the least, is indesirable.

One phase of our invention is concerned with the production of a slurry of solid fuel in water which slurry is suitable for feed to a generator for the gasification of the solid fuel by partial oxidation. One problem presented in such a gasification procedure is that the rate of feed of the solid fuel should be constant. When the solid fuel is suspended in a gas such as steam or oxygen, it is difficult to feed the fuel at a constant rate in that on occasion a slug of fuel may enter the gasifier resulting in a surplus of fuel. This means that some fuel will pass through the gasifier unconverted. At other times there may be a temporary fuel deficiency resulting in a surplus of oxygen with the resulting conversion of a portion of the solid fuel to $CO_2$ rather than the desired CO. One satisfactory commercial method of controlling the rate and composition of the feed is to introduce the feed into the gasifier as a slurry in water. However, because of the short residence time of the solid fuel in the gasifier it must necessarily be finely ground so that in such a short space of time it may be substantially completely gasified. Frequently, a slurry of low grade solid fuel, e.g. sub-bituminous coal or lignite, to be pumpable, contains from about 35 to 50% water. Although such a slurry is pumpable, it is unsatisfactory as the excessive amount of water has a detrimental effect on the thermal efficiency of the furnace. It is therefore important for the satisfactory operation of the gasifier that a watersolid fuel slurry used as feed have a high solids content and yet be pumpable.

The situation is aggravated when the solid carbonaceous fuel is of low quality such as sub-bituminous coal, lignite or peat.

Millions of tons of low rank fuels such as sub-bituminous coal and lignite exist in this country and although many of the deposits are readily mined, they are not used extensively as fuels, because for the most part, they are located at substantial distance from the point of ultimate use and, in addition, they have several characteristics which make them less attractive as fuels. For example, although generally they have a relatively low sulfur content, these low rank fuels still contain too much sulfur to permit their use as a fuel and still meet current regulations with respect to $SO_2$ emissions. In addition, to take these coals economically attractive, means must be found for separating the components of the coal having little or no heating value from the components having a high heating value. Thus inorganic mineral matter, water and carbon dioxide are desirably removed from such fuels to produce a fuel having a higher BTU/lb value and thereby produce a fuel which is more economic to transport either by rail or pipeline.

Therefore, it is an object of this invention to remove as much moisture as conveniently practical from the solid prior to its transportation or use. Also, it is an object of this invention to dehydrate low ranking solid fuel and inhibit rehydration of the surface with alcohols and multi-ring aromatic compounds for preparing slurries with higher BTU contents and higher solid concentration levels.

2. Disclosure Statement

U.S. Pat. No. 2,610,115 discloses both a method and an apparatus for drying lignite and similar high moisture content lignitic fuels to produce a relatively moisture-free, stable and storable fuel.

U.S. Pat. No. 3,996,026 discloses a process for feeding a high solids content solid fuel-water slurry to a gasification process where the water content is between 35 and 55 wt. %.

U.S. Pat. No. 4,047,898 discloses a process for the hydrothermal treatment, i.e., upgrading, of a low rank solid fuel in the presence of hydrogen and heating a particulate mixture of such solid fuel in an inert atmosphere to a temperature between about 300° and 700° F.

U.S. Pat. No. 4,057,399 discloses a process for dewatering carbonaceous materials such as coal by a treatment with hydrogen at elevated temperatures.

U.S. Pat. No. 4,104,035 discloses a method of preparing a solid fuel water slurry by heating to a temperature above 300° F. under sufficient pressure to maintain the water in a liquid phase, and adding a surface active agent to form a mixture having a water content between 40 and 50 wt. %.

U.S. Pat. No. 4,166,802 discloses a process for the gasification of low quality solid fuel where a sufficient amount of moisture is removed to provide a high solids content fuel for such gasification process.

U.S. Pat. No. 4,212,112 discloses a method of drying solid carbonaceous materials such as coal by treatment with an azeotrope, i.e., water and benzene at a temperature of 156°-320° F. for a period of about 10 minutes to about 4.0 hours.

U.S. Pat. No. 4,223,449 discloses a process for dewatering hydrocarbonaceous solid fuels with a solvent such as benzene or toluene at elevated temperatures, i.e., 200°-600° F., and a pressure of about 1 to 100 atmospheres.

U.S. Pat. No. 4,304,572 discloses a process for improving the pumpability of a high solids content water slurry of a solid fuel (e.g., sub-bituminous coal) by forming a slurry containing $NH_4OH$ and a surface-active agent comprising a salt of an organic sulfonic acid.

SUMMARY OF THE INVENTION

This invention provides a method for making a high solids content low rank coal of a coal/water slurry for a coal gasification process. The method comprises:

(a) dehydrating a low rank coal feed at a temperature ranging from about 90° to about 110° C.;

(b) treating the dehydrated coal with a rehydrating inhibitor; and (c) adding a surfactant to the treated coal, whereby the solids content of the coal/water slurry is increased from about 5 to about 20 wt. % and the BTU/lb. of the coal is increased from about 5% to about 15%.

DETAILED DESCRIPTION OF THE INVENTION

The coal/water slurry of this invention comprises a high solids content low rank coal, and according to the present invention, a method is provided to produce a high solids content low rank coal which is useful in a coal/water slurry gasification process.

The present method for making an effective, high solids content low rank coal/water slurry is accomplished by first grinding the coal to a mesh size ranging from about 1000 to about 37 microns, or less, and then dehydrating the ground coal at a temperature ranging from about 90° to about 110° C. in the presence of an inert atmosphere of nitrogen. The source of heat may be steam and such steam may be supplied by the coal gasification process for which the low rank coal is being provided. In the dehydration of the low rank coal, the low rank coal is heated in the presence of a solvent or is brought in contact with such solvent while being heated at a temperature of about 90° to about 110° C. and under a pressure ranging from about 14.7 to about 1400 psi. The coal is subjected to heat for a period of about 1.0 minute to about 1.0 hour.

According to the present invention, a rehydrating inhibitor may be added during or after the dehydration of the low rank coal. The inhibitor is added to inhibit and restrict any rehydration of the surface of the coal in order to assure that the coal is not subsequently hydrated and becomes ineffective and not useful in the coal gasification.

Upon dehydration and inhibiting the rehydration of the coal, a surfactant, i.e., a surface active agent may be added, during or after dehydration, to the coal/water slurry in an amount sufficient to form a pumpable slurry which can be introduced into a gasification zone of a coal gasification process.

Also, the surfactants of this invention have been found to be beneficial in promoting a greater amount of dehydration, i.e., water removed from low rank coal, and increase the solids content of the low rank coal.

While any surfactant, i.e., surface active agent, may be used in the process of our invention, it has been found that anionic surface active agents comprising an alkali metal or alkaline earth metal salt of an organic sulfonic acid are superior, to other types of surface active agents. Examples of particularly suitable surface active agents are the calcium, sodium and ammonium salts of organic sulfonic acids such as 2,6-dihydroxy naphthalene sulfonic acid and lignite sulfonic acid. In this connection, ammonia is considered as an alkali metal. The surface active agent may be present in the slurry in an amount between about 0.01 and 3.0 wt. %, a preferred amount being between about 0.1 and about 2.0 wt. %.

A surfactant that has proven to be effective is ammonium lignosulfonate which is manufactured and marketed, under the trademark of ORZAN A, by Crown Zellerbach Corporation, Chemical Products Division of Vancouver, Wash.

The low rank coal of this invention before being dehydrated and mixed into a water slurry is ground and dried at a temperature of about 100° F. in a nitrogen ($N_2$) atmosphere. The coal, for example, a Lake DeSmet coal may be ground and dry sieved through 40, 60, 100, 200, and 325 mesh screens in proportions as set forth below in Table I.

TABLE I

| Mesh Size | Percent |
|---|---|
| 40 × 60 | 6.0 |
| 60 × 100 | 38.0 |
| 100 × 200 | 24.0 |
| 200 × 325 | 9.0 |
| −325 | 23.0 |

The solid fuels which may be treated by the present method include any solid fuel such as coal or coke and the like but it is particularly adapted to sub-bituminous coal and lignite which contain relatively large amounts of water as mixed. Suitably the solid fuel is ground so at least 70% passes through a 200 mesh and preferably at least 70% passes through a 325 mesh sieve (U.S.A. Standard Series).

The analysis of different solid fuels is provided below in Tables II, III, IV, V.

TABLE II

| Analysis of Sub-Bituminous Coal | | |
|---|---|---|
| Ultimate Analysis | As Received | Moisture Free |
| Moisture, % | 17.0 | — |
| Carbon, % | 49.0 | 52.6 |
| Hydrogen, % | 3.1 | 3.3 |
| Nitrogen, % | 0.64 | 0.69 |

TABLE III

| Analysis of Alabama Lignite | | |
|---|---|---|
| Ultimate Analysis | As Received | Moisture Free |
| Moisture, % | 47.3 | — |
| Carbon, % | 33 3 | 63.2 |
| Hydrogen, % | 2 6 | 4.9 |
| Nitrogen, % | 0.6 | 1.1 |
| Sulfur, % | 1.8–1.9 | 3.4–3.5 |
| Ash, % | 6.2 | 11.8 |
| Oxygen (diff.), % | 8.2 | 15 8 |
| Heat of Combustion | | |
| Gross Btu/lb. | 5949 | 11,276 |
| Net Btu/lb. | 5670 | 10,747 |

TABLE IV

| Analysis of Wyoming Sub-Bituminous Coal (Lake DeSmet) | | |
|---|---|---|
| Ultimate Analysis | As Received | Moisture Free |
| Moisture, % | 19.5 | — |
| Carbon, % | 39.4 | 49.0 |
| Hydrogen, % | 3.4 | 4.2 |
| Nitrogen, % | 0.6 | 0.7 |
| Sulfur, % | 1.4 | 1.7 |
| Ash, % | 28.4 | 35.3 |
| Oxygen (Bu Diff.), % | 7.3 | 9.1 |
| Heat of Combustion | | |
| Gross Btu/lb. | 5936 | 7370 |
| Net Btu/lb. | 5628 | 7224 |

TABLE V

| Analysis of California Lignite | |
|---|---|
| Ultimate Analysis | |
| Moisture, % | 37.2 |
| Carbon, % | 19.2 |
| Hydrogen, % | 4.3 |
| Nitrogen, % | 0.5 |
| Sulfur, % | 0.9 |
| Ash, % | 18.6 |
| Oxygen | 19.3 |

TABLE V-continued

| Analysis of California Lignite | |
|---|---|
| Ultimate Analysis | |
| Total | 100.00 |

The solvent which is used, i.e., present, in the dehydration of the coal may be toluene or any xylene.

The rehydrating inhibitor may be a ($C_3$–$C_{12}$) alcohol or a multi-ring aromatic compound such as an aromatic oil.

The alcohols, which may be used as a rehydrating inhibitor, include hexanol, 2-ethyl-hexanol, hexadecanol decyl and lauryl alcohol or combinations thereof. The preferred alcohol is decyl.

The aromatic oils, which may be used as a rehydrating inhibitor, include multi-ring aromatic compounds, preferably creosote oil which consists of 70 percent naphthalene and higher multi-ring aromatics.

In addition, multi-ring aromatic compounds which are the primary components of coal tar, may be used as the rehydrating inhibitor. These include anthracene, alpha and beta naphthalene, dimethyl naphthalene, acenaphthene, fluorene, phenanthrene and carbazole.

Also, it has been found that an ester may be used as a rehydrating inhibitor. A good example of a useful ester is poly methyl methacrylate.

The amount of rehydrating inhibitor, e.g., alcohol, used ranges from about 1.0 to about 10.0 wt. %, based on the weight of coal treated.

In the present process, i.e., the dehydration of and the addition of the rehydrating inhibitor and surfactant, to the coal/water slurry, in addition to increasing the solids content of the coal, the BTU/lb level of the coal feed is increased. According to the present invention, the solids content is increased from about 5 to about 20 wt. % and the BTU/lb is increased from about 5 to about 15%.

In order to determine the effectiveness of the dehydration, rehydrating inhibitor and surfactants, the coals were prepared, treated and tested. The following is a summary of the steps taken in order to determine the effectiveness of the present method. The discussion below is merely taken as an example and not limiting the application and scope of the present invention.

PREPARATION OF COAL SAMPLE

A Lake DeSmet Coal (LDS Sample No. BRL 82-3349) was dry sieved using 40, 60, 100, 200, 325 mesh screens and a pan. Following this, two blends with the following percentages, were made:

1. 6%, 40×60 mesh; 38%, 60×100 mesh; 24%, 100×200 mesh; 9%, 200×325 mesh; 23%, −325 mesh.
2. 25%, 200×325 mesh and 75%, −325 mesh.

The two blends with the 60×100 mesh fraction were dried at 100° F. with a $N_2$ atmosphere before being used in the dehydrating tests.

LOADING (FEEDING) OF REACTOR

Loading of the reactor involved:

(1) adding the desired sample of coal (about 100 gms) to the flask;

(2) dissolving the rehydration inhibitor in 100 gms of toluene and adding it to the flask; and (3) initiating $N_2$ flow over the sample.

Base line experiments were performed without toluene and/or without rehydration inhibitor.

DEHYDRATION

Following a satisfactory loading, the water flow is initiated and the heater was turned on. The rheostat was placed on the maximum setting to achieve a heating rate of about 100° C./hr. Upon reaching the desired dehydration temperature (about 100° C.) the flask was held at that temperature for about a 15 minute reaction time to ensure that all the water and solvent had condensed. The ultimate analysis of LDS coal sample is carbon 43.6 wt. %; hydrogen 2.9 wt. %; nitrogen 0.73 wt. %; sulfur, 1.0 wt. %; oxygen (by diff.) 19.27 wt. %; ash 32.5 wt. %.

VISCOSITY TEST

To determine the improvement, if any, to the solids concentration of the treated samples (dehydrated LDS coal+rehydration inhibitor)/water slurries, the following procedure was observed: 1. viscosities at high and low shear using the maximum solids concentration viscometer (MSCV) were measured. 2. the solids concentration was then increased at constant increments, with the viscosities determined at each new solids concentration. The process was continued until the viscosities exceeded 700 cP (considered to be the limit of pumpability). At the end of the same test, 1% (by weight of the coal) of a surfactant, e.g., Orzan A (ammonium lignosulfonate) was added to the coal slurry to determine the improvement on the viscosity. The results at 700 cP, the maximum pumpability solids concentration (MPSC), are given in Table VI for the alcohols and in Table VII for the aromatic oils, e.g., creosote oil.

The results show that dehydration followed by treatment with the rehydration inhibitors, (e.g., decyl alcohol) increases the solids concentration of a sub-bituminous coal slurry from 48.5% to 55.2% solids (by weight of coal). This is accompanied with an increased BTU value of the feed from 7,521 BTU/lb to 8,233 BTU/lb.

TABLE VI

Concentration of Solids at 700 cP
(maximum pumpable slurry concentration)
ALCOHOLS

| Slurry | |
|---|---|
| 1. LDS coal*, untreated | 48.5 |
| 2. LDS coal, dehydrated | 49.7 |
| 3. LDS coal + toluene (solvent) dehydrated | 49.9 |
| 4. LDS coal + toluene + 5% (by weight of coal) Lauryl alcohol (dehydrated) | 50.2 |
| 5. LDS coal + toluene + 5% (by weight of coal) polyethylene glycol (dehydrated) | 49.3 |
| 6. LDS coal + toluene + 5% hexadecanol (dehydrated) | 51.0 |
| 7. LDS coal + toluene + 5% decylalcohcol (dehydrated) | 53.2 |
| 8. LDS coal + toluene + 5% Hexadecylalcohol | Not measured |
| 9. LDS coal + toluene + 5% Poly acrylic acid | 49.8 |
| 10. LDS coal + toluene + 5% Poly methyl methacrylate | 52.7 |

*LDS coal (75%, −325 mesh; 25%, 200 × 325 mesh)

TABLE VII

Concentraion of Solids at 700 cP
(maximum pumpable slurry concentration)
AROMATIC OILS

| Slurry | MPSC (wt %) |
|---|---|
| 1. LDS coal*, untreated | 48.5 |
| 2. LDS coal, dehydrated | 49.7 |
| 3. LDS coal + toluene (solvent) dehydrated | 49.9 |
| 4. LDS coal + toluene + 5% (by weight of | 51.4 |

TABLE VII-continued

| Concentraion of Solids at 700 cP (maximum pumpable slurry concentration) AROMATIC OILS | |
|---|---|
| Slurry | MPSC (wt %) |
| coal) Diesel fuel (#2) (dehydrated) | |
| 5. LDS coal + toluene + 10% (by weight of coal) Diesel fuel (#2) (dehydrated) | not measured (slurry too thick) |
| 6. LDS coal + toluene + 5% (by weight of coal) Avjet fuel (dehydrated) | 50.8 |
| 7. LDS coal + tolune + 5% petroleum residue (dehydrated) | 50.2 |
| 8. LDS coal ± toluene + 1% (by weight of coal) creosote oil** (dehydrated) | 50.0 |
| 9. LDS coal + toluene + 5% (by weight of coal) creosote oil (dehydrated | 55.2 |
| 10. LDS coal + toluene + 10% (by weight of coal) creosote oil (dehydrated) | not measured |

*LDS coal (75%, −325 mesh; 25%, 200 × 325 mesh)

**creosote oil is 70% naphthalene and higher multi-ring aromatics

In order to show the effect of adding a surfactant to a treated sample of dehydrated, rehydrated coal, a solution of 1 percent, by weight of coal, was added and the effect of the surfactant, e.g., Orzan A, is recorded below in [2]Table VIII for the alcohols and Table IX for aromatic oils. From the results, it is clear that the surfactant increases the solid content of low rank coal by at least about 1.0 wt. % to about 2.0 wt. %, or an average of about 1.7 wt. %.

TABLE VIII

| Effect of adding 1% by weight cf the coal of Orzan A to the treated sample ALCOHOLS | | |
|---|---|---|
| Surfactant | Slurry | MSP (wt. %) |
| None | LDS coal* + toluene + 5% (by weight of coal) Hexadecane dehydrated | 53.2 |
| Orzan A | LDS coal + toluene + 5% by weight of coal hexadecane (dehydrated) | 54.9 |

*LDS coal (75%, −325 mesh; 25%, 200 × 325 mesh).

TABLE IX

| Effect of adding 1% by weight of the coal of Orzan A to the treated sample AROMATIC OILS | | |
|---|---|---|
| Surfactant | Slurry | MPSC (wt. %) |
| None | LDS coal* + toluene + 5% by weight of coal) Hexadecane dehydrated | 55.2 |
| Orzan A | LDS coal + toluene + 5% by weight of coal creosote oil (dehydrated) | 56.9 |

*LDS coal (75%, −325 mesh; 25%, 200 × 325 mesh).

We claim:

1. A method for preparing a high solids content low rank coal of a coal/water slurry for a coal gasification process which method comprises:

(a) dehydrating a low rank coal feed with a solvent in the presence of an inert atmosphere of nitrogen at a temperature ranging from about 90° to about 110° C. and under a pressure of about 14.7 to about 1400 psi for a period of about 1.0 minute to about 1.0 hours;

(b) treating said dehydrated coal with about 10.0 wt % by weight of said coal of an alkanol selected from the group consisting of butanol, pentanol, hexanol, 2-ethyl-hexanol, hexadecanol, decyl and lauryl alcohol or combinations thereof rehydrating inhibitor; and (c) adding between about 0.001 and about 3.0 wt. % of a surfactant to said treated coal, whereby the solids content of the coal/water slurry is increased from about 5 to about 20 wt. % and the BTU/lb of said coal feed is increased by about 5 percent to about 15 percent.

2. The method of claim 1, wherein the alcohol is decyl alcohol.

3. A method for preparing a high solids content low rank coal of a coal/water slurry for a coal gasification process which method comprises:

(a) dehydrating a low rank coal feed with a solvent in the presence of an inert atmosphere of nitrogen at a temperature ranging from about 90° to about 110° C. and under a pressure of about 14.7 to about 1400 psi for a period of about 1.0 minute to about 1.0 hour;

(b) treating said dehydrated coal with about 10.0 wt % by weight of said coal of a poly methyl methacrylate rehydrating inhibitor; and (c) adding between about 0.001 and about 3.0 wt % of a surfactant to said treated coal, whereby the solids content of the coal/water slurry is increased from about 5 to about 20 wt. % and the BTU/lb of said coal feed is increased by about 5 percent to about 15 percent.

* * * * *